US007621433B2

(12) United States Patent
Ivarsson

(10) Patent No.: US 7,621,433 B2
(45) Date of Patent: Nov. 24, 2009

(54) STAPLER

(75) Inventor: Bengt Ivarsson, Åsenhöga (SE)

(73) Assignee: Isaberg Rapid AB (SE)

( * ) Notice: Subject to any disclaimer, the term of this patent is extended or adjusted under 35 U.S.C. 154(b) by 0 days.

(21) Appl. No.: 10/588,302

(22) PCT Filed: Dec. 16, 2004

(86) PCT No.: PCT/SE2004/001897

§ 371 (c)(1),
(2), (4) Date: Apr. 27, 2007

(87) PCT Pub. No.: WO2005/075151

PCT Pub. Date: Aug. 18, 2005

(65) Prior Publication Data

US 2007/0210135 A1 Sep. 13, 2007

(30) Foreign Application Priority Data

Feb. 5, 2004 (SE) ..... 0400223

(51) Int. Cl.
*B25C 5/02* (2006.01)
*B25C 5/11* (2006.01)

(52) U.S. Cl. ..... 227/155; 227/154; 227/8; 227/134

(58) Field of Classification Search ..... 227/134, 227/132, 155
See application file for complete search history.

(56) References Cited

U.S. PATENT DOCUMENTS 1,612,870 A * 1/1927 Leschhorn ..... 227/155
1,773,823 A * 8/1930 Polzer ..... 227/155
1,810,528 A * 6/1931 Peterson ..... 227/113
1,852,060 A * 4/1932 Peterson ..... 227/155
5,004,142 A * 4/1991 Olesen ..... 227/155
5,516,025 A * 5/1996 Eriksson ..... 227/155
5,678,745 A * 10/1997 Yoshie ..... 227/4
6,036,074 A * 3/2000 Manabe ..... 227/155
6,637,635 B2 * 10/2003 Borjesson et al. ..... 227/155
6,991,146 B2 * 1/2006 Sinisi et al. ..... 227/134

FOREIGN PATENT DOCUMENTS

DE 610274 C 3/1935

(Continued)

*Primary Examiner*—Rinaldi I. Rada
*Assistant Examiner*—Lindsay Low
(74) *Attorney, Agent, or Firm*—Miles & Stockbridge P.C.

(57) ABSTRACT

Stapler (1) which comprises a base part (2) and a stapling unit (3). The base part consists of a lower part (5) and an upper part (6) which are connected together such that they from each other, and between which parts is arranged a first elastic element (8) which, in an initial position, moves the upper and lower parts apart. A workpiece to be stapled is placed on the upper part (6), where an opening (31) is arranged through which the legs of the staple is driven after that the legs have driven through the workpiece, and to which upper part bending devices (21, 22), pivotable about pivot pins (25, 26), are connected. The upper part being blocked from moving downward by a blocking arrangement (21, 22, 25, 26, 44, 45) when the driver drives the staple legs through the workpiece. The blocking device is disengaged by means of a releasing device (53, 54, 55, 56) when the staple crown (40) contacts the upper surface (17) of the workpiece.

8 Claims, 11 Drawing Sheets

FOREIGN PATENT DOCUMENTS

| | | | |
|---|---|---|---|
| DE | 663962 | C | 8/1938 |
| DE | 646864 | C | 6/1973 |
| GB | 462957 | A | 3/1937 |
| GB | 517352 | A | 1/1940 |
| WO | WO 96/09917 | A1 | 4/1996 |

* cited by examiner

STAPLER

TECHNICAL FIELD

The present invention relates to a stapler for stapling together a workpiece, primarily a sheaf of papers, by means of a staple, which stapler comprises a base part and a stapling unit which, by means of a connecting means, are connected in such manner that they can be moved towards and away from each other as part of a reciprocating stapling action, and in which the stapling unit incorporates a magazine in which staple blanks are stored and a driver which, during the stapling action, drives a staple blank, which is formed into a shape consisting of a first and a second leg with an intermediate crown, through an outlet opening which is in connection with the magazine, and in which the base part comprises a lower and an upper part, which upper part is connected in such manner to the lower part that it can be moved towards and away from the lower part, and between which parts is provided a first elastic element which, in an initial position, moves the upper and lower parts apart, the upper part being provided with a surface on which the workpiece to be stapled is placed and in which surface is arranged an opening through which the legs of the staple driven by the driver pass after the legs have passed through the workpiece, and to which upper part bending devices, arranged pivotably about individual pivot pins, are connected in the area under the opening, the upper part, in the initial position, being blocked, by means of a blocking arrangement, from being moved in a downward direction towards the lower part when the driver drives the staple legs through the workpiece, and which blocking arrangement is disengaged by a releasing arrangement when the driver has driven the staple into a position in which the crown of the staple is in contact with the upper surface of the workpiece, whereupon the upper part and the stapling unit are moved towards the lower part, causing the bending devices, by interaction with the lower part, to be pivoted about their respective pivot pins in the direction of the upper part, thereby moving the staple legs against the underside of the workpiece.

STATE OF THE ART

Staplers of the type described above are already known, one example being that described in patent document WO 96/09917. However, a disadvantage of these known staplers is that since their respective blocking arrangements and releasing arrangements are located separately from the bending devices, the arrangements interact and control the action of the bending devices without the said bending devices being part of these arrangements, with the result that the arrangements comprise a large number of parts, making them difficult both to manufacture and assemble.

PROBLEM

Thus, there exists a need for a stapler equipped with a blocking arrangement and a releasing arrangement of a design such that they comprise a small number of parts and, thereby, are easy to manufacture and assemble.

SOLUTION

The present invention overcomes the above disadvantages by means of a stapler of the type described in the introduction, which is characterised in that the blocking arrangement incorporates the bending devices which, in the initial position, are in blocking contact with the lower part, preventing the upper part from being moved in the direction of the lower part.

The present invention is also characterised in that the bending devices are provided respectively with a first contact point, which, in the initial position, are in contact individually with the lower part at a respective second contact point, each of which points is located essentially directly below the pivot centre of a respective bending device.

The present invention is further characterised in that the bending devices are moved to the initial position by a third elastic element.

The present invention is yet further characterised in that the bending devices are prevented by blocking means from being pivoted in a direction opposite to that in which they move when bending the staple legs.

The present invention is even yet further characterised in that the releasing arrangement of the bending devices comprises releasing legs provided on the stapling unit, which interact with means provided on the bending devices to release the bending devices from the blocking position.

BRIEF DESCRIPTION OF FIGURES

The present invention will hereinafter be described with reference to the appended figures, of which.

PREFERRED EMBODIMENT

Figure 1:
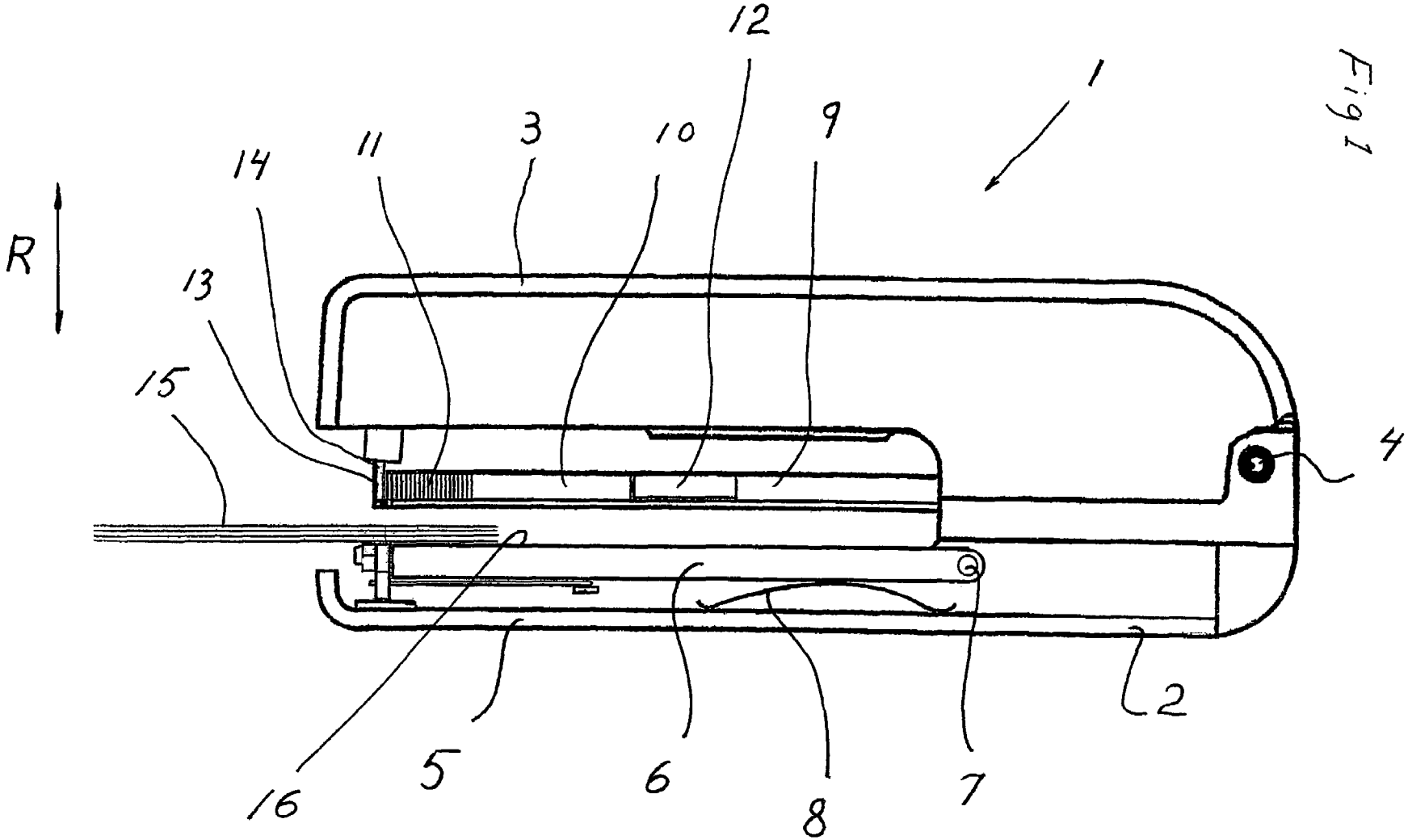
FIG. 1 is a general view in which a stapler in accordance with the present invention is shown in an initial position and in which parts facing the viewer are rendered transparent to permit a better view of the invention.

FIG. 1 shows a stapler 1 comprising a base part 2 and a stapling unit 3, which are connected to each other by a first pivot pin 4 in such manner that they can be moved towards and away from each other in a reciprocating stapling movement as indicated by the double arrow R. The base part 2 comprises a lower part 5 and an upper part 6. The upper part 6 is connected to the lower part 5 by a second pivot pin 7 and the upper part and lower part can also be moved towards and away from each other in a reciprocating stapling movement as indicated by the double arrow R. In the initial position shown in FIG. 1, the upper part is maintained at a distance from the lower part by a first elastic element 8 which, in the figure, is shown as a leaf spring. The stapling unit 3 houses a staple magazine 9, in which staples are stored in the form of a strip 10. The staples forming the strip are located side by side as indicated by the lines 11. The strip 10 is fed in known manner by a feeding device 12 in the direction of an outlet opening 13 arranged in the front end of the magazine and, when stapling is carried out in the manner which will be described below, the front staple is driven through the opening by a driver 14 arranged in the stapling unit. The figure also shows a workpiece 15, consisting primarily of a sheaf of papers, placed on an upper surface 16 of the upper part 6.

Figure 2:
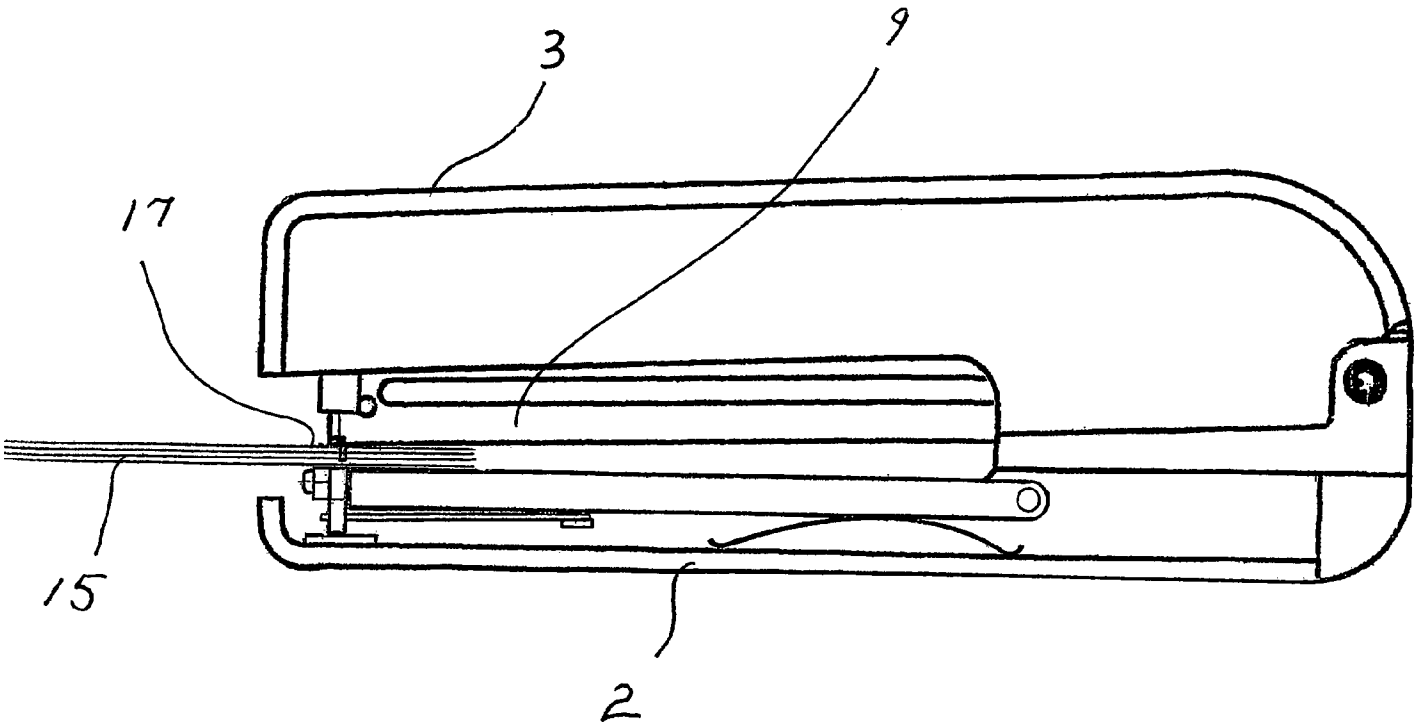
FIG. 2 is a view corresponding to FIG. 1 in which the stapler is shown in an intermediate position during a stapling cycle.
Figure 3:
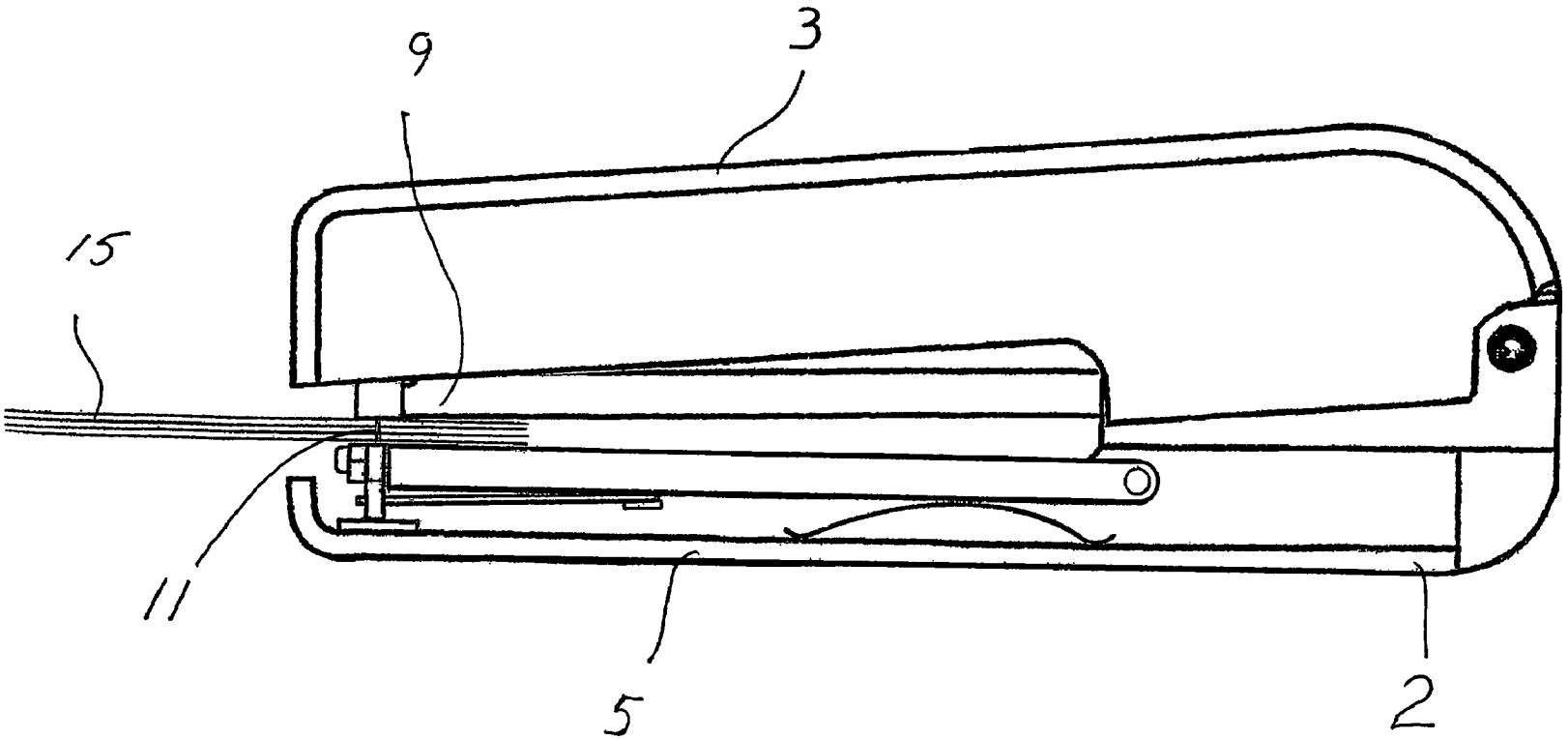
FIG. 3 is a view corresponding to FIG. 1 in which the stapler is shown at a further stage of a stapling cycle.
Figure 4:
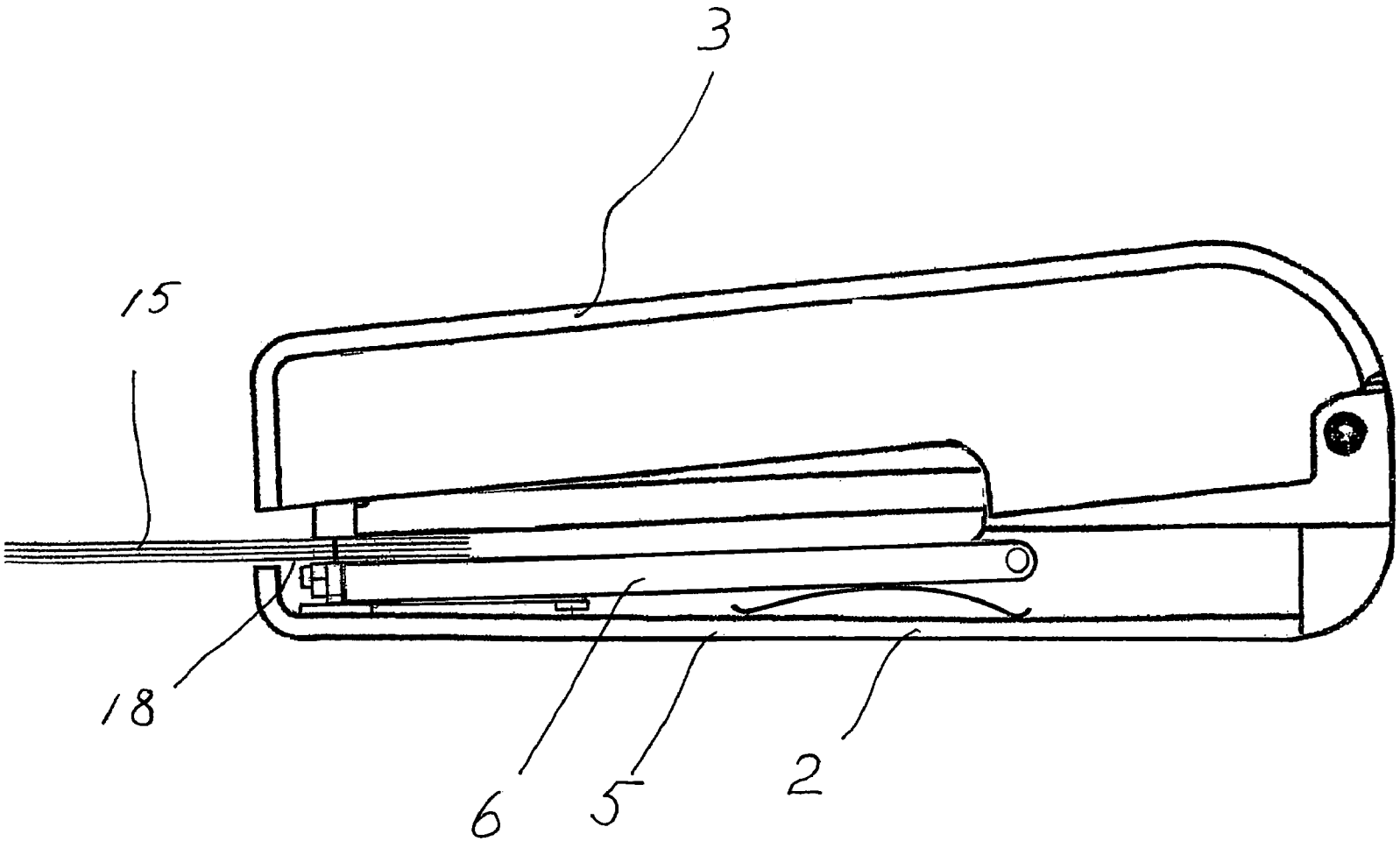
FIG. 4 is a view corresponding to FIG. 1 in which the stapler is shown at the end of a stapling cycle.

A cycle in which stapling is carried out will be described in a number of stages with reference to FIGS. 1-4. In FIG. 1, the stapler is shown in an initial position and the base part 2 and stapling unit 3 are moved apart from each other in known manner by means of a second elastic element, which is not shown in the figures. In this position, the upper part 6 is maintained apart from the lower part 5 by the leaf spring 8. The figure further shows that the workpiece 15 is placed on the upper surface 16. In FIG. 2, the stapling unit has been moved in the direction of the lower part and the front end of the magazine 9 has come into contact with the upper side 17 of the workpiece 15. In FIG. 3, the stapling unit 3 has been moved further towards the lower part 5 and, in this position, the driver 14 has driven a staple 11 through the workpiece. In FIG. 4, the stapler has reached the bottom position of the cycle and, in this position, the staple has, in a manner which will be described below with reference to FIGS. 5-9, been bent into contact with the underside 18 of the workpiece 15 and the upper part 6 has also been moved downward against the lower part 5. On completion of the stapling cycle, the stapler is returned by the second elastic element to the initial position shown in FIG. 1 and the upper part 6 is returned to the initial position by the leaf spring 8.

Figure 10:
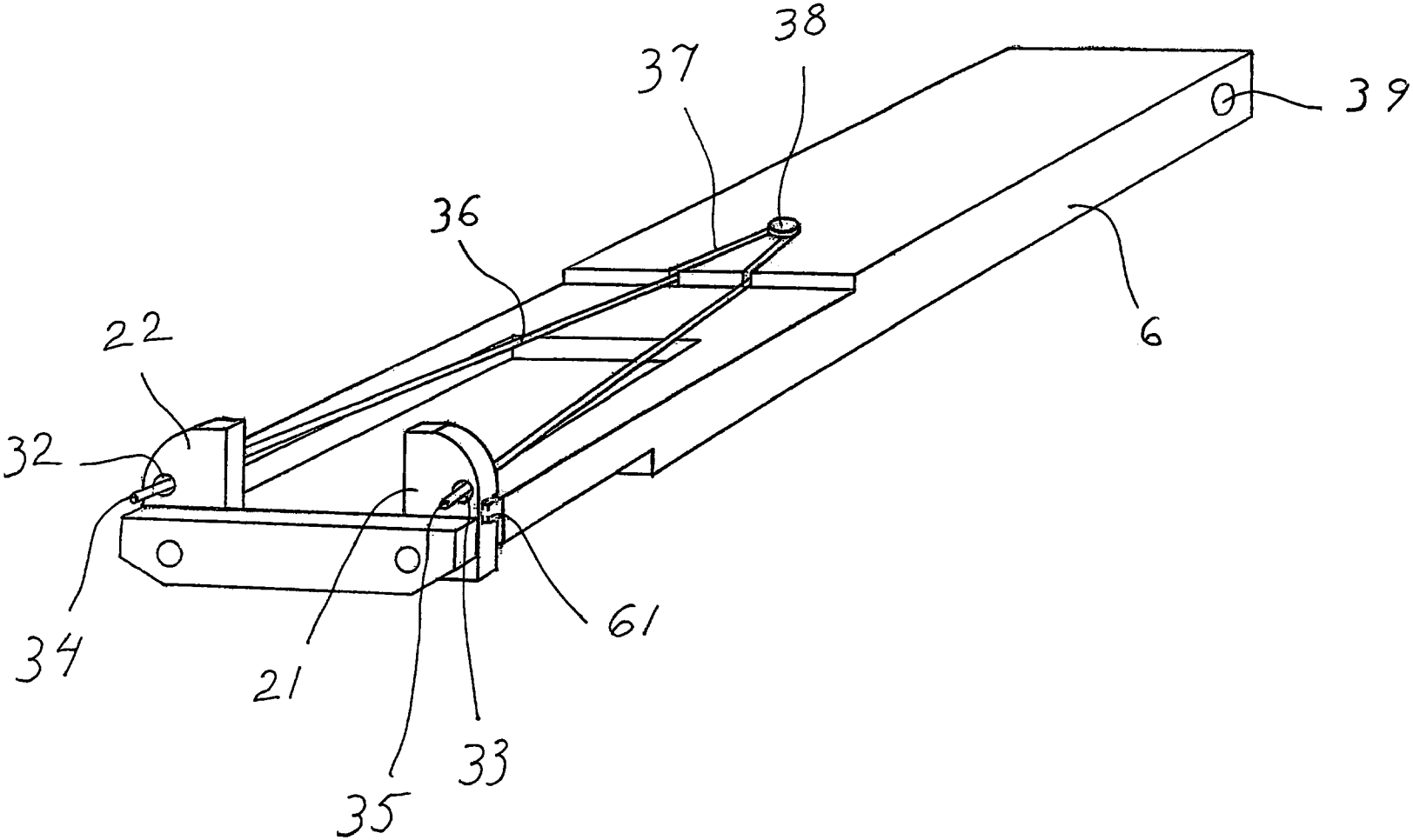
FIG. 10 is a view showing the upper part included in the invention as seen from below.
Figure 11:
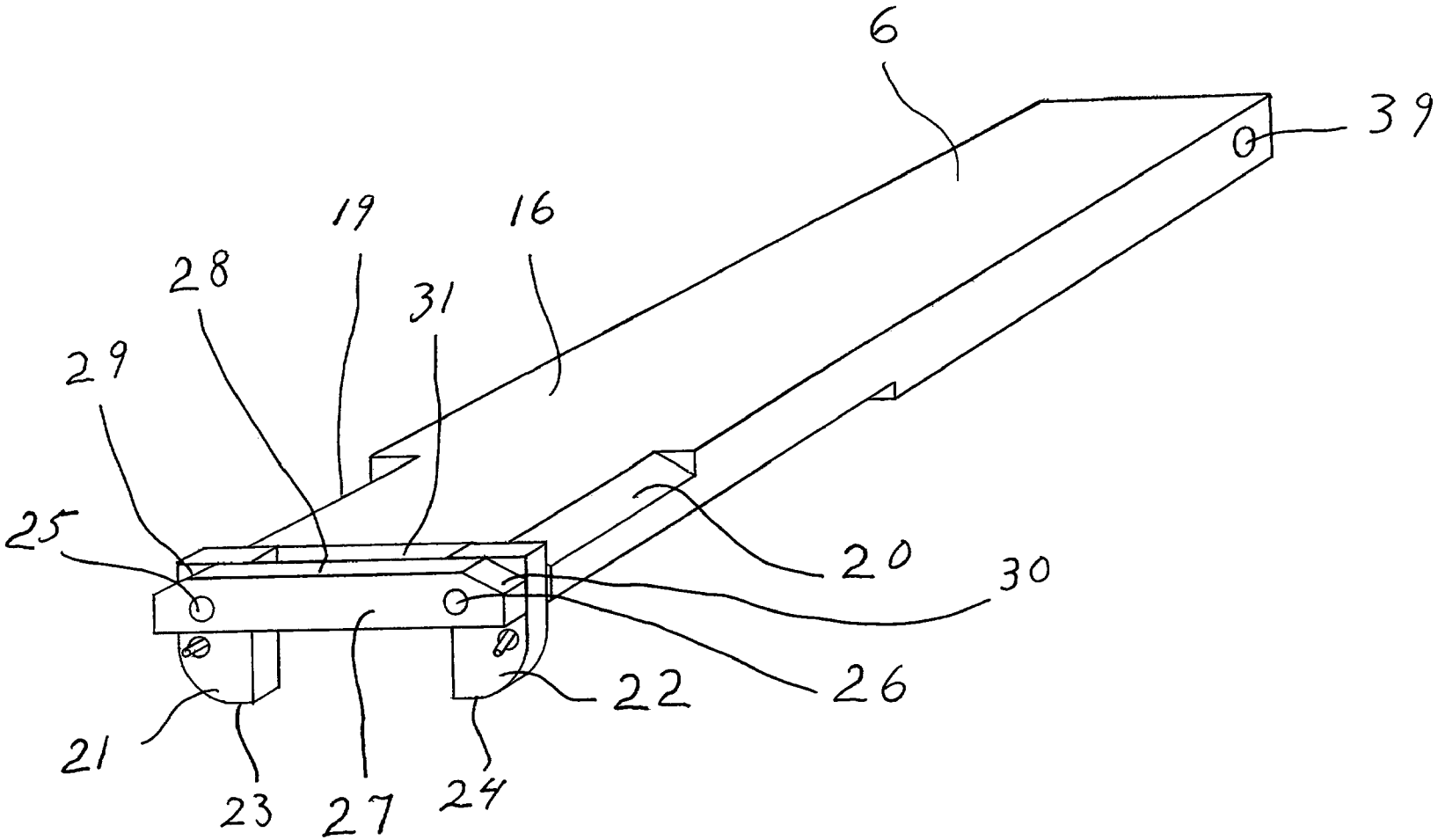
FIG. 11 is a view showing the upper part shown in FIG. 10 as seen from above.

The upper part 6 is shown in detail in FIGS. 10 and 11. In FIG. 11, the part is shown from above and the figure shows that the upper part has an upper surface 16 which, at the front end, is provided with chamfered edges 19 and 20. The figure also shows the bending devices 21 and 22 provided with flat surfaces 23 and 24 respectively, which bending devices are connected respectively to the part 6 by means of pivot pins 25 and 26. A boom 27 is arranged in front of the bending devices 21, 22, with its upper surface 28 flush with the upper surface 16. The surface 28, which thus forms part of the surface 16, is also provided with chamfered edges 29 and 30, which may be regarded as extensions of the chamfered edges 19 and 20 respectively and, thus, form part of the latter.

An opening 31 is thus formed in the surface 16, 28 between the part 6 and the boom 27, the function of which opening will be clear from the description below. FIG. 10, in which the part 6 is seen from the side facing downward towards the lower part 5, shows that the bending devices are provided with holes 32 and 33 respectively, and that in these holes are inserted the legs 34 and 35 respectively of a third elastic element 36 which, in the example, consists of a hairclip spring which, at the bent end 37, is permanently attached and secured to the part 6 by means of a fixing device 38. The figures further show that the rear end of the part is provided with a cylindrical hole 39 through which the second pivot pin 7 (not shown in the figures) extends and by which pivot pin the upper part is connected to the lower part.

Figure 5:
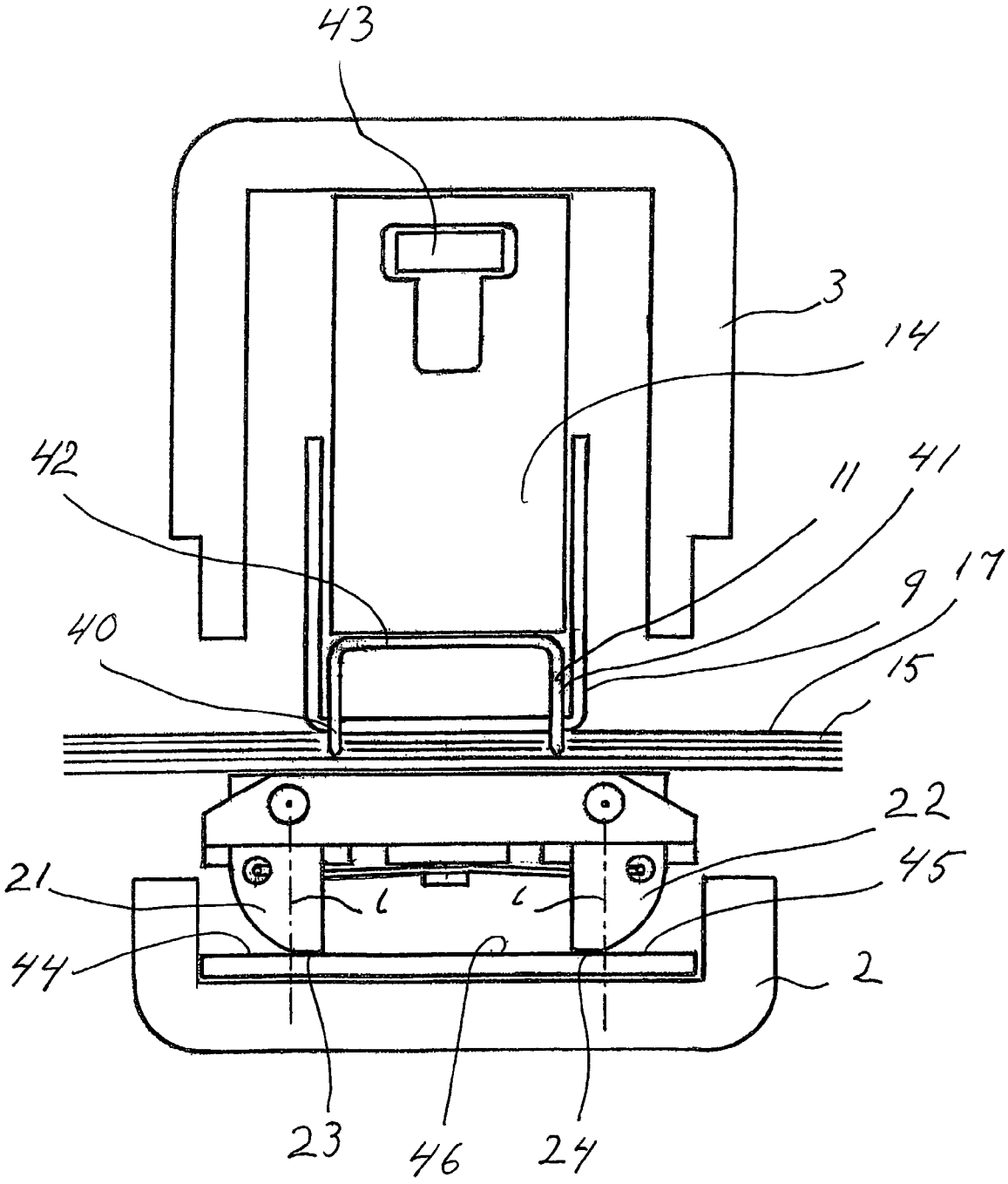
FIGS. 5-9 are schematic views showing a stapler in accordance with the present invention, as viewed from the front, during a stapling cycle sequence and with parts essential to the invention exposed.
Figure 6:
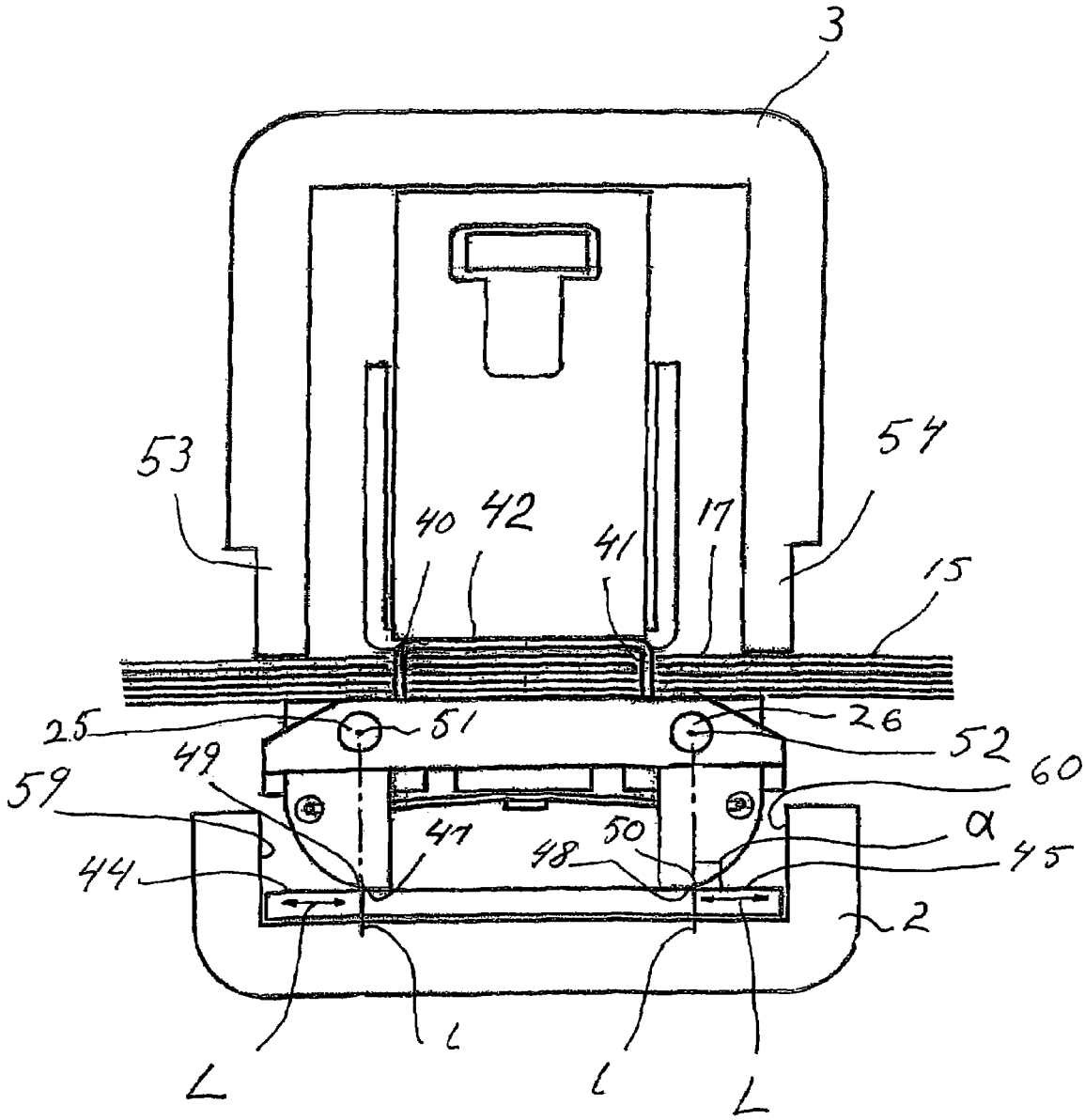
Figure 7:
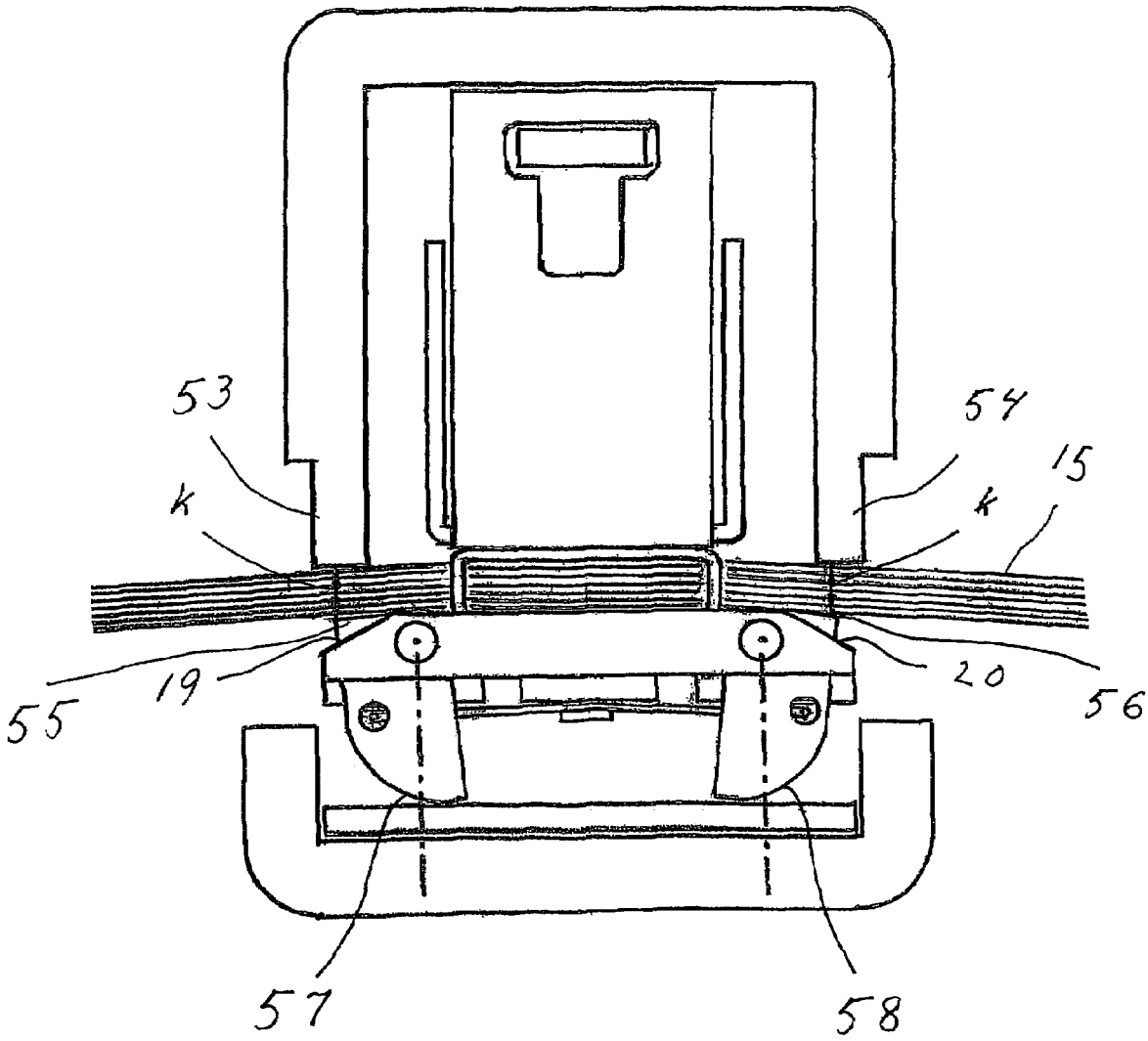
Figure 8:
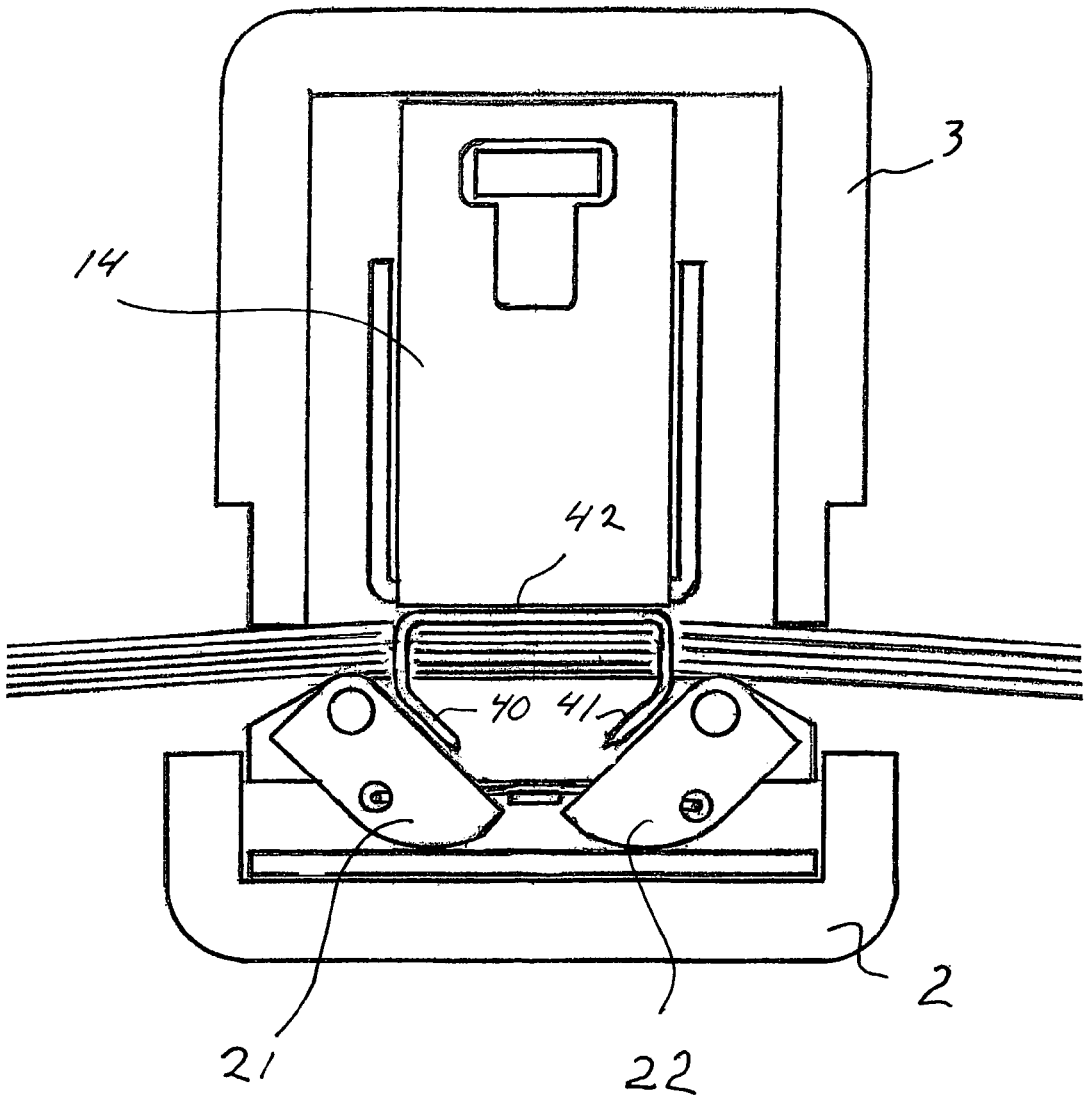
Figure 9:
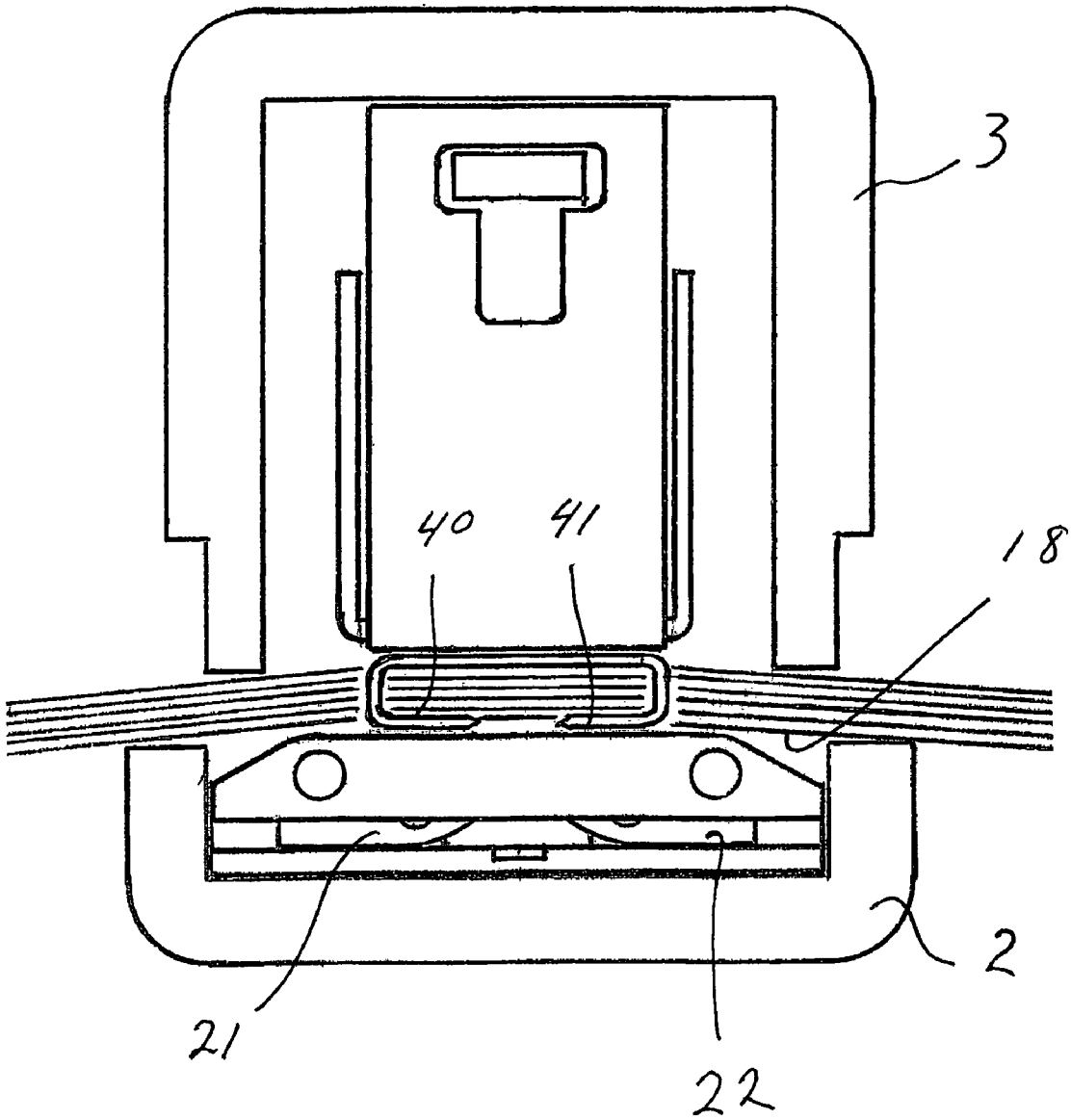

The invention will now be described with reference to FIGS. 5-9, which schematically illustrate the stapler as seen from the front and from which views, parts which obscure parts essential to the invention have been omitted. In FIG. 5, the invention is shown in a position in which a stapling cycle has been commenced and in which the stapling unit 3 has been moved from the initial position shown in FIG. 1 towards the base part 2, and in which position the magazine 9 has been moved into contact with the upper surface 17 of the workpiece 15 and in which a staple 11 has been driven partly through the workpiece 15 by the driver 14. The staple consists of a first and a second leg 40, 41 with an intermediate crown 42. The driver 14 is connected to the stapling unit 3 by a connecting device 43. The bending devices 21 and 22 are still in the initial position, with the flat faces 23, 24 in blocking contact with the areas 44 and 45 respectively on the bottom 46 of the lower part. In the figure, the bottom consists of a spacer attached to the lower part, although this spacer is not necessary to the operation of the invention and the invention will function even if the bending devices are in direct contact with the lower part 5. When the bending devices are in the position shown in the figure, which position is also shown in FIG. 6, contact points 47,48 on the bending devices are in contact respectively with the areas 44 and 45 at respective second contact points 49,50, which are located on the lower part directly below the respective pivot centres 51,52 of the bending devices on the pivot pins 25,26 and which are indicated by the lines 1 in FIGS. 5 and 6, which lines also represent the vertical axes of the respective pivot centres. The location of these contact points is such that the bending devices are prevented from pivoting about their pivot pins when the driver drives a staple through the workpiece, so that the bending devices function as blocking arrangements and prevent the upper part 6 from being moved downward towards the lower part 5. In FIG. 6, the driver has driven the staple into the workpiece to a position in which the staple crown 42 is pressed against the workpiece and in which position the legs 40 and 41 have entered the opening 31 and the bending devices are still in blocking contact with the lower part 5. In this position, furthermore, a first and a second releasing leg 53,54 arranged on the stapling unit have come into contact with the upper surface 17 of the workpiece 15. When the stapling unit is moved further in the direction of the base part, the legs exert a force on the releasing means 55 and 56 respectively arranged on the bending devices, which force, as indicated by the double arrows k in FIG. 7, is transmitted through the workpiece, and which transmission of force is facilitated by the fact that the surface 16 in the area below the legs is provided with chamfered edges 19 and 20, which permit the workpiece 15 to be bent downward. Under the applied force, the bending devices, as shown in FIG. 7, are pivoted about their pivot pins in such manner that they are disengaged from their blocking position, whereupon the stapling unit and upper part are moved downward towards the lower part, causing the curved faces 57,58 on the bending devices, interacting in known manner with the lower part, to pivot the bending devices about their pivot pins, thus bending the staple legs into contact with the underside 18 of the workpiece 15 as shown in FIGS. 8-9. The boom 28 has been omitted from FIG. 8 to illustrate the bending of the staple legs more clearly. On completion of stapling, the stapling unit and upper part are returned by the first and second elastic elements to the initial position shown in FIG. 1, and the bending devices are returned to their initial position by the hairclip spring 36.

In the embodiment shown, the bending devices are shown with their contact points located directly below their respective pivot centres. However, these points may be in contact with their respective areas at points located essentially directly below the specified points, since minor deformation of the bending devices may occur when these are subjected to pressure by the releasing legs 53,54, which deformation may permit the points to be in contact with a point slightly to the side of the specified points and the respective sides 59, 60 of the base part. When this point is located slightly to the side of specified points, but towards the centre of the stapler, the inherent friction ensures that the function of the bending devices is maintained. The longitudinal extensions of the areas 44 and 45 are also shown, which extensions are indicated by the arrows L at right-angles to the vertical axes of the respective pivot pins, although this angle $\alpha$ may be varied between 85 and 95 degrees. Varying the angle $\alpha$ enables the force k required to disengage the bending devices from their blocked position to be varied. Since the bending devices bear against the contact area with their flat faces, the bending devices are prevented from rotating about the pivot pins in a direction opposite to that described above when the driver drives a staple through the workpiece. To ensure that the bending devices cannot be pivoted in this opposite direction, the base part can be provided with latching devices to prevent such movement and FIG. 10 shows a latch 61, indicated by broken lines, arranged on the upper part 6 to act as a latching device of this type. Although the figure shows only one latching device for the bending device 21, it will be clear to one skilled in the art that the bending device 22 is also provided with such a latching device.

The invention has been shown as part of a manually operated stapler; however, it may equally well be used in a stapler forming part of a copying machine, primarily an electric machine. In these staplers, the connecting devices may be so arranged that they connect the base part and stapling unit either in a pivoting movement, as illustrated in the present figures, or in a linear movement, which is not illustrated in the present figures but will be well known to one skilled in the art.

The invention claimed is:

1. A stapler for stapling together a workpiece with a staple, wherein the stapler comprises a base part and a stapling unit which, are connected in such manner that they can be moved towards and away from each other in a reciprocating stapling movement, and in which the stapling unit incorporates a magazine in which staples are stored and a driver which, during the stapling movement, drives a staple which is formed into a shape including a first leg and a second leg with an intermediate crown through an outlet opening connected to the magazine, and in which the base part includes a lower part and an upper part, which is connected to the lower part in such manner that it can be moved towards and away from the lower part, and between the parts is arranged a first elastic element which, in an initial position, urges the upper and lower parts apart, the upper part being provided with a surface on which the workpiece to be stapled is placed and in the surface is arranged an opening through which the legs of the staple driven by the driver pass after the legs have been driven through the workpiece, and to which upper part bending devices arranged pivotably about individual pivot pins are connected in the area under the opening, the upper part, in the initial position, being blocked from being moved in a downward direction towards the lower part by a blocking arrangement when the driver drives the staple legs through the workpiece, and in which the blocking arrangement is disengaged by a releasing arrangement when the driver has driven the staple to a position in which the staple crown is in contact with the upper surface of the workpiece, whereupon the upper part and stapling unit are moved towards the lower part, causing the bending devices, by interaction with the lower part, to be moved, by pivoting about their respective pivot pins, in a direction towards the upper part, whereupon the staple legs are moved by the bending devices against the underside of the workpiece, CHARACTERISED IN THAT the blocking arrangement comprises the bending devices which, in the initial position, are in blocking contact with a rigid surface on the lower part, that is spaced from the upper part, and that is fixed against movement in the downward direction, preventing the upper part from being moved in the direction of the lower part, and in that the releasing arrangement comprises releasing legs arranged on the stapling unit, which interact with releasing devices arranged on the bending devices to release the bending devices from the blocking position.

2. A stapler in accordance with claim 1, CHARACTERISED IN THAT the bending devices are provided respectively with a first contact point which, in the initial position, are in contact individually with the lower part at respective second contact points, on the rigid surface, each of said points is located essentially directly below the pivot center of a respective bending device.

3. A stapler in accordance with claim 1, CHARACTERISED IN THAT the bending devices are moved to their initial position by an third elastic element.

4. A stapler in accordance with claim 1, CHARACTERISED IN THAT the bending devices are prevented by latches from being pivoted in a direction opposite to that in which the bending devices bend the staple legs.

5. A stapler in accordance with claim 2, CHARACTERISED IN THAT the bending devices are moved to their initial position by an elastic element.

6. A stapler in accordance with claim 5, CHARACTERISED IN THAT the bending devices are prevented by latches from being pivoted in a direction opposite to that in which the bending devices bend the staple legs.

7. A stapler in accordance with claim 2, CHARACTERISED IN THAT the bending devices are prevented by latches from being pivoted in a direction opposite to that in which the bending devices bend the staple legs.

8. A stapler in accordance with claim 3, CHARACTERISED IN THAT the bending devices are prevented by latches from being pivoted in a direction opposite to that in which the bending devices bend the staple legs.

* * * * *